US010014564B2

(12) United States Patent
Yatabe

(10) Patent No.: US 10,014,564 B2
(45) Date of Patent: Jul. 3, 2018

(54) DIELECTRIC WAVEGUIDE RESONATOR AND FILTER COMPRISED OF A PAIR OF DIELECTRIC BLOCKS HAVING OPPOSING SURFACES COUPLED TO EACH OTHER BY A PROBE

(71) Applicant: TOKO, INC., Tsurugashima-shi (JP)

(72) Inventor: Yukikazu Yatabe, Wako (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/485,360

(22) Filed: Sep. 12, 2014

(65) Prior Publication Data

US 2015/0077198 A1 Mar. 19, 2015

(30) Foreign Application Priority Data

Sep. 13, 2013 (JP) ..... 2013-189933

(51) Int. Cl.
*H01P 1/20* (2006.01)
*H01P 1/208* (2006.01)

(52) U.S. Cl.
CPC ..... *H01P 1/2002* (2013.01); *H01P 1/2084* (2013.01)

(58) Field of Classification Search
CPC .. H01P 5/107; H01P 5/087; H01P 5/08; H01P 1/2002; H01P 1/2138; H01P 7/00; H01P 7/10; H01P 1/2053
USPC ..... 333/126, 135, 202, 208, 212, 219.1
See application file for complete search history.

(56) References Cited

U.S. PATENT DOCUMENTS

| | | | | |
|---|---|---|---|---|
| 3,462,713 | A * | 8/1969 | Knerr | H01P 5/107 333/21 R |
| 4,716,387 | A * | 12/1987 | Igarashi | H01P 5/107 333/208 |
| 4,725,793 | A * | 2/1988 | Igarashi | H01P 5/107 333/208 |
| 6,198,450 | B1 | 3/2001 | Adachi et al. | |
| 2001/0043158 | A1 | 11/2001 | Adachi et al. | |
| 2001/0054978 | A1 | 12/2001 | Adachi et al. | |
| 2010/0148891 | A1 | 6/2010 | Sano | |
| 2012/0049983 | A1 | 3/2012 | Uhm et al. | |
| 2012/0206213 | A1 | 8/2012 | Kojima et al. | |

FOREIGN PATENT DOCUMENTS

| | | |
|---|---|---|
| CN | 1296306 | 5/2001 |
| CN | 1581570 | 2/2005 |
| JP | 07-147505 | 6/1995 |

(Continued)

*Primary Examiner* — Benny Lee
(74) *Attorney, Agent, or Firm* — Cozen O'Connor

(57) ABSTRACT

The present invention provides a dielectric waveguide resonator comprising a pair of rectangular parallelepiped-shaped dielectric blocks being in contact with each other through respective contact surfaces thereof. The dielectric waveguide resonator has an outer periphery coated with an electrically conductive film except for the contact surfaces, and is configured to resonate in a TE mode. A probe composed of an electrically conductive film is formed on at least one of the contact surface. Thus, it becomes possible to provide a dielectric waveguide resonator having a simple structure, requiring no adjustment structure, and comprising a structure for conversion between a dielectric waveguide and a coaxial line.

7 Claims, 8 Drawing Sheets

(56) References Cited

FOREIGN PATENT DOCUMENTS

| | | |
|---|---|---|
| JP | 09-008541 | 1/1997 |
| JP | 10-322108 | 12/1998 |
| JP | 2005-064682 | 3/2005 |
| JP | 2010-141644 | 6/2010 |
| JP | 2012-147286 | 8/2012 |

* cited by examiner

FIG.2
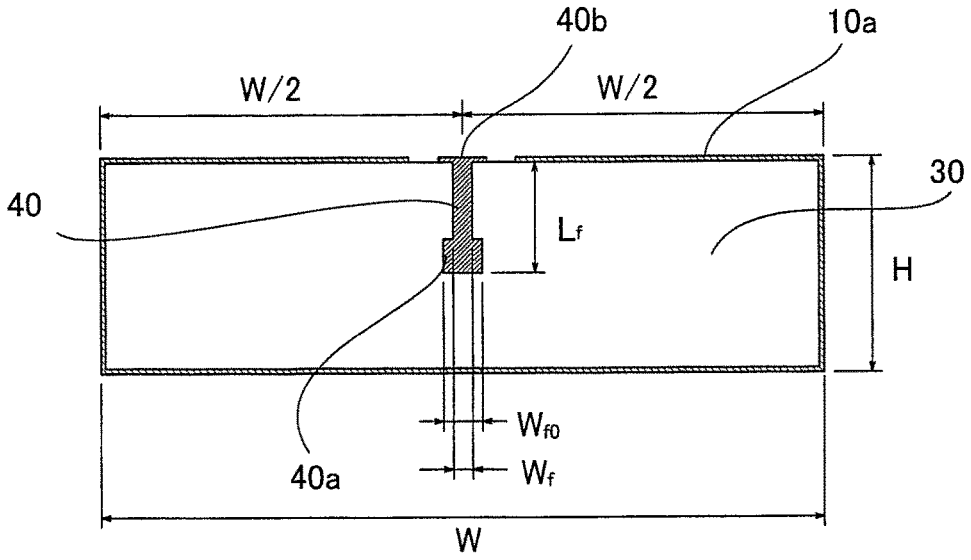
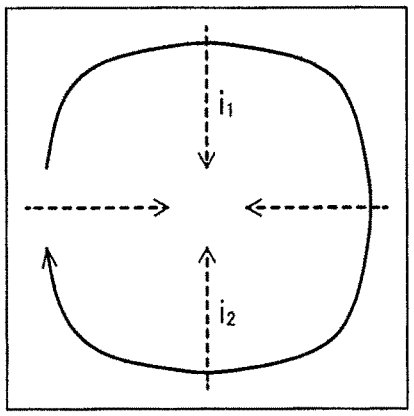
FIG. 3A
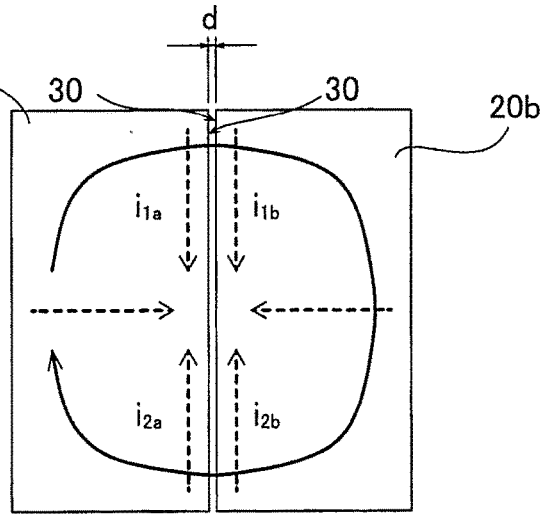
FIG. 3B

DIELECTRIC WAVEGUIDE RESONATOR AND FILTER COMPRISED OF A PAIR OF DIELECTRIC BLOCKS HAVING OPPOSING SURFACES COUPLED TO EACH OTHER BY A PROBE

CROSS-REFERENCE TO RELATED APPLICATION

The present application claims the benefit of priority based on Japanese Patent Application No. 2013-189933 filed on Sep. 13, 2013, the contents of which are incorporated herein by reference.

BACKGROUND OF THE INVENTION

Field of the Invention

The present invention relates to a TE mode dielectric waveguide resonator, and, in particular, to a dielectric waveguide resonator having an input/output structure with respect to a coaxial line.

Description of the Related Art

There has been used a dielectric waveguide resonator comprising a dielectric waveguide which is compact and light-weight as compared to a large and heavy hollow waveguide. The dielectric waveguide resonator comprising the dielectric waveguide can be directly mounted on a printed circuit board formed with a microstrip line, using a structure for conversion between the dielectric waveguide and the microstrip. As the structure for conversion between the dielectric waveguide and the microstrip, a type as described in the Patent Document JP2012-147286A or JP2010-141644A has been known.

FIG. 12 is an exploded perspective view illustrating a dielectric waveguide resonator having a conventional structure for conversion between the dielectric waveguide and the microstrip. A dielectric waveguide resonator 90 comprises a rectangular parallelepiped-shaped dielectric block 91 having an approximately circular island-shaped electrode 92 in a bottom surface thereof, wherein the island-shaped electrode 92 is surrounded by an exposed dielectric portion and by an electrically conductive film 93 coating an exterior of the dielectric block 91 with an interval from the island-shaped electrode 92. An outer periphery of the dielectric block 91 and the electrically conductive film of the island-shaped electrode 92 are formed by printing.

A printed circuit board 94 comprises an approximately circular input/output electrode 95 provided in a main front surface thereof and surrounded by a front surface-side ground pattern 96 with an interval, and a microstrip line 97 provided on a main rear surface thereof. The center of the input/output electrode 95 is connected to a distal end of the microstrip line 97 via a through-hole 98. The dielectric waveguide resonator 90 is disposed on and electrically connected to the main front surface of the printed circuit board 94 by a solder or the like, in such a manner as to allow the island-shaped electrode 92 and the electrically conductive film 93 to be faced to the input/output electrode 95 and the front surface-side ground pattern 96 respectively.

SUMMARY OF THE INVENTION

Problem to be Solved by the Invention

The dielectric waveguide resonator having such a structure for conversion between the dielectric waveguide and the microstrip has the following problems:

an area occupied by the microstrip line cannot be reduced because the microstrip line is required to have a certain level of length;

it may be required to have a metal case cover on the microstrip line to provide measures against leakage of electromagnetic field caused by an irradiation from the microstrip line; and a loss or an unwanted emission caused by concentration of electric field between the dielectric waveguide resonator and the printed circuit board cannot be avoided in the structure for conversion between the dielectric waveguide and the microstrip due to its structural reason.

Use of a structure for conversion between the hollow waveguide and the coaxial line comprising a linear probe composed of an electrical conductor inserted in the resonator, which is an input/output structure of a hollow waveguide resonator different from the dielectric waveguide, prevents occurrence of the above problems. However, this approach is required to have an adjustment structure for adjusting the probe position (for example, Patent Document JPH10-322108A) because the amount of insertion or the position of the probe acts on the characteristic of the probe. Since the hollow waveguide has a hollow internal space and is large in shape, incorporating the adjustment structure can be performed relatively easily. However, the dielectric waveguide has a dielectric body in its internal space and is small in size, so that it is difficult to incorporate the adjustment structure in the resonator. For this reason, as the input/output structure of the dielectric waveguide resonator, the structure for conversion between the dielectric waveguide and the microstrip has been used rather than the structure for conversion between the hollow waveguide and the coaxial line.

Means for Solving the Problem

According to the present invention, there is provided a dielectric waveguide resonator comprising a rectangular parallelepiped-shaped dielectric block having an outer periphery coated with an electrically conductive film, the dielectric waveguide resonator configured to resonate in a TE mode, wherein the dielectric block comprises: a pair of rectangular parallelepiped-shaped dielectric block pieces being in contact with each other through respective contact surfaces thereof each parallel to an electric field direction; and a probe composed of an electrically conductive film and formed on at least one of the contact surfaces.

Effect of the Invention

The present invention makes it possible to provide a dielectric waveguide resonator having a simple structure, requiring no adjustment structure, and comprising a structure for conversion between a dielectric waveguide and a coaxial line.

BRIEF DESCRIPTION OF THE DRAWINGS

FIG. 2 is an illustration explaining in detail a contact surface of FIG. 1.

FIGS. 3A and 3B are illustrations for explaining a principle of the dielectric waveguide resonator according to the present invention.

DETAILED DESCRIPTION OF THE INVENTION

First Embodiment

A dielectric waveguide resonator of the present invention will now be described with reference to the drawings.

Figure 1:
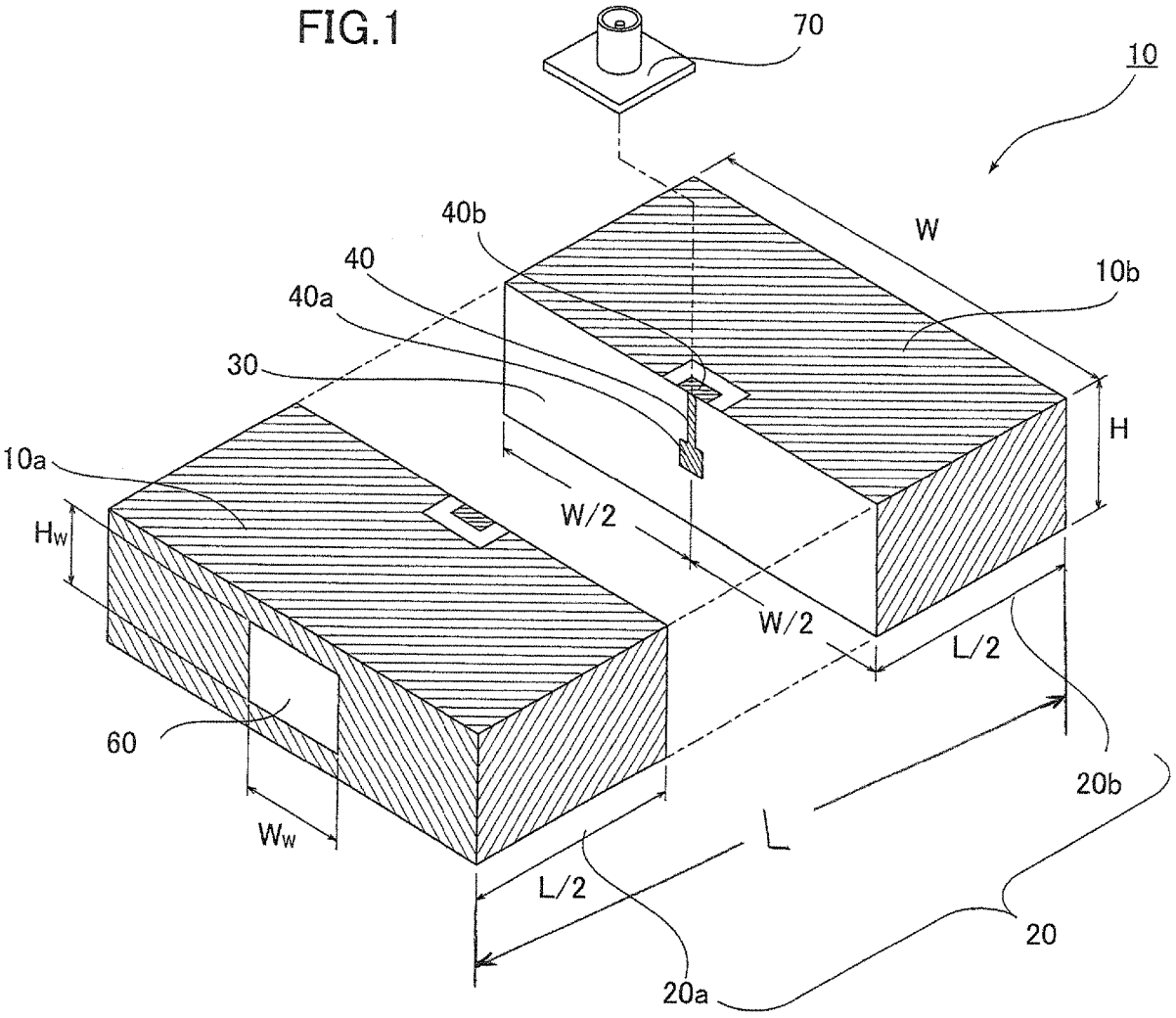
FIG. 1 is an exploded perspective view illustrating a first embodiment of a dielectric waveguide resonator according to the present invention.

FIG. 1 is an exploded perspective view illustrating a first embodiment of a dielectric waveguide resonator according to the present invention, and FIG. 2 is an illustration for explaining in detail a contact surface 30 of FIG. 1. In FIGS. 1 and 2, the shaded area represents an electrically conductive film.

A dielectric waveguide resonator 10 (FIG. 1) is a TE mode resonator. As illustrated in FIGS. 1 and 2, the dielectric waveguide resonator 10 (FIG. 1) comprises a dielectric block 20 (FIG. 1) having an outer periphery coated with an electrically conductive film, and a coaxial connector 70 (FIG. 1). The dielectric block 20 (FIG. 1) has a parallelepiped-shape with a length L, width W and height H, comprising parallelepiped-shaped dielectric block pieces 20*a* and 20*b* as illustrated in FIG. 1, each having a length L/2, width W and height H, in contact with each other at a contact surface 30 (FIG. 1) with a width W and height H. The width W is made up of two portions W/2. That is, the parallelepiped-shaped dielectric block pieces 20*a* and 20*b* has an outer periphery coated with electrically conductive films 10*a* and 10*b* (FIG. 1) respectively, except for their contact surface 30. The dielectric block has one side surface provided with a coupling window 60 having a height $H_w$×a width $W_w$ as illustrated in FIG. 1 and exposing a dielectric body, for connecting to other dielectric waveguide resonator.

In a longitudinally central area of the contact surface on the outer periphery of the dielectric block 20, a feeding point 40*b* insulated from the electrically conductive films 10*a* and 10*b* is disposed, and a probe 40 composed of an electrically conductive film and extending from the feeding point 40*b* into the contact surface 30 is formed.

The probe 40 is formed in a foil shape with a length $L_f$ and width $W_f$ as illustrated in FIG. 2, and has a distal end 40*a* having a width $W_{f0}$ which is wider than the width $W_f$ to achieve an impedance matching.

The coaxial connector 40 is connected to the feeding point 40*b* and the electrically conductive films 10*a* and 10*b*.

The formation of the probe 40 on the contact surface 30 is performed by printing as with the formation of the electrically conductive films on the outer periphery of the dielectric block. The positioning of the probe is easily performed and can be performed with very high accuracy by printing. Thus, it is almost not necessary to adjust the probe position, so that any adjustment structure is not needed. An external Q-value is adjusted by the length $L_f$ of the probe 40.

The above described dielectric waveguide resonator 10 comprises a probe 40 printed between the dielectric block pieces 20*a* and 20*b*, so that there is a small gap d (FIG. 3B) resulting from the thickness of the printed probe. The thickness of the electrically conductive film is approximately 25 μm, and the electrically conductive films 10*a* and 10*b* are not connected to each other on the outer periphery of the dielectric waveguide resonator 10.

However, in the dielectric waveguide resonator of the present invention, it is not necessary to connect the electrically conductive films 10*a* and 10*b* to each other on the outer periphery of each contact surface, or to fill the gap d with other dielectric materials. It may only be necessary to simply arrange the dielectric block pieces in such a manner as to allow each contact surface to come contact with each other. Further, the electrically conductive films 10*a* and 10*b* are only required to be at least connected to each other at one point by a connector 70. The reason thereof will be described below.

FIGS. 3A and 3B are plain views for explaining an operational principle of the dielectric waveguide resonator according to the present invention, in which FIG. 3A illustrates a dielectric waveguide resonator in the case where the dielectric block is not divided, and FIG. 3B illustrates a dielectric waveguide resonator in the case where the dielectric block is divided into dielectric block pieces 20*a* and 20*b* being in contact with each other through respective contact surfaces 30. In FIGS. 3A and 3B, the solid line represents a magnetic field inside the dielectric waveguide resonator, and the dashed line represents a surface current generated on the surface of the dielectric waveguide resonator.

If the dielectric waveguide resonator is a TE mode resonator, the magnetic field and surface current appear as illustrated in FIG. 3A. In this case, if the dielectric block is divided into dielectric block pieces 20*a* and 20*b* parallel to the surface currents $i_1$ and $i_2$ as illustrated in FIG. 3A, then $i_1$ is divided into $i_{1a}$ and $i_{1b}$, and $i_2$ is divided into $i_{2a}$ and $i_{2b}$, so that the magnetic field and surface current will be as illustrated in FIG. 3B. In either of FIG. 3A or 3B, no change occurs in the direction of the surface currents. Originally, there is no surface current flowing between the surface currents $i_{1a}$ and $i_{1b}$, and between $i_{2a}$ and $i_{2b}$. Thus, if the electrically conductive films 10*a* and 10*b* are not connected to each other on the outer periphery of the dielectric waveguide resonator 10, it does not have any effect. Therefore, the resonator illustrated in FIG. 3B is also operable as a resonator as with the resonator illustrated in FIG. 3A.

That is, as long as the dielectric block is divided parallel to the surface current generated in the electrically conductive films 10*a* and 10*b* on the outer periphery, the resultant small gap d does not have any effect on the surface current, and thus on the characteristic of the resonator. Since the gap d is sufficiently small with respect to the wavelength of the resonant frequency in the dielectric waveguide resonator, even if there is a gap between the dielectric blocks, it does not cause any leakage of electromagnetic field, and thus it does not have any effect on the characteristic of the resonator.

Second and Third Embodiments

Figure 4:
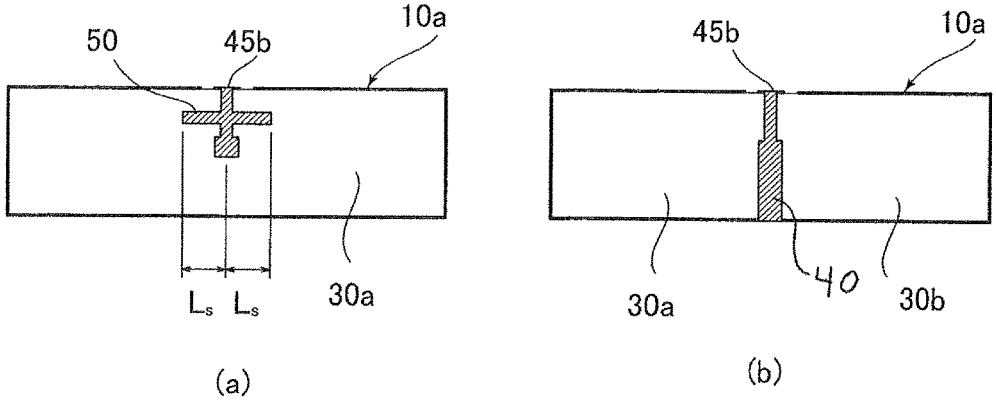
FIG. 4A is an illustration explaining a contact surface of second embodiment of the dielectric waveguide resonator according to the present invention.
FIG. 4B is an illustration explaining a contact surface of third embodiment of the dielectric waveguide resonator according to the present invention.

FIGS. 4A and 4B illustrate other embodiments of the dielectric waveguide resonator according to the present invention. FIG. 4A illustrates a contact surface of the second embodiment, and FIG. 4B illustrates a contact surface of the third embodiment. In FIG. 4A and FIG. 4B, 45*b* shows the feeding point. Structures other than the contact surface are essentially the same as the dielectric waveguide resonator illustrated in FIG. 1, so that any explanation thereof will be omitted.

As illustrated in FIG. 4A, it may be possible to provide a stub 50 having a length Ls, extending on opposite sides of the probe. Generally, in order to suppress the harmonic, a low-pass filter is added. However, addition of low-pass filter results in increased loss, number of components, and cost, as well as reduced power durability. The present invention makes it possible to suppress the harmonic only by adding the stub instead of the low-pass filter. The stub is particularly effective in suppression of third harmonic.

In addition, as illustrated in FIG. 4B, it may also be possible to form the distal end of the probe 40 as a short circuit structure extending to the electrically conductive film 10*a* on the opposed side of the feeding point 45*b*. Having the short circuit structure allows the external Q-value to be smaller and the resonator to have wider bandwidth.

Figure 5:
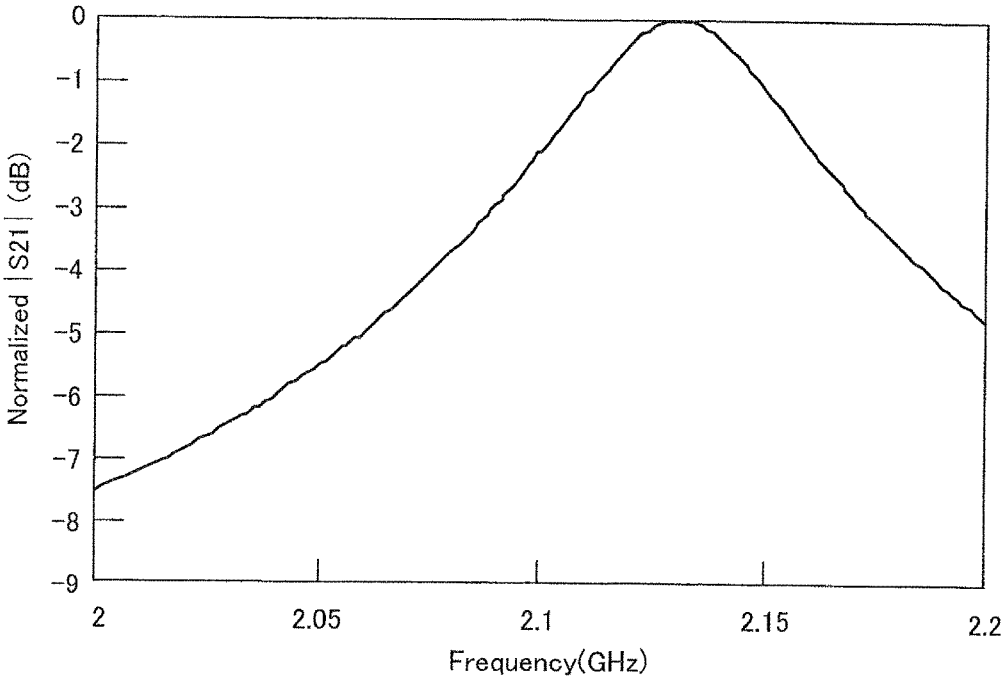
FIG. 5 is a graph illustrating an insertion loss around a resonant frequency in the second embodiment of the dielectric waveguide resonator according to the present invention.

FIG. 5 is a graph of an insertion loss of the dielectric waveguide resonator (normalized |S21|) of the second embodiment around a resonant frequency, normalized with its maximum value. In FIG. 5, the horizontal axis represents a frequency in GHz, and the vertical axis represents a value measured in dB.

The dielectric waveguide resonator is designed to have the following values:

resonant frequency: 2.13 GHz;

dimension of the dielectric waveguide resonator 10: L=20.35 mm, W=22 mm, H=4 mm;

dimension of the probe 40: $L_f$=2.8 mm, $W_f$=0.8 mm;

dimension of the stub 50: $L_s$=2.8 mm; and relative permittivity of the dielectric block pieces 20*a* and 20*b*: $\varepsilon_r$=21.

Figure 6:
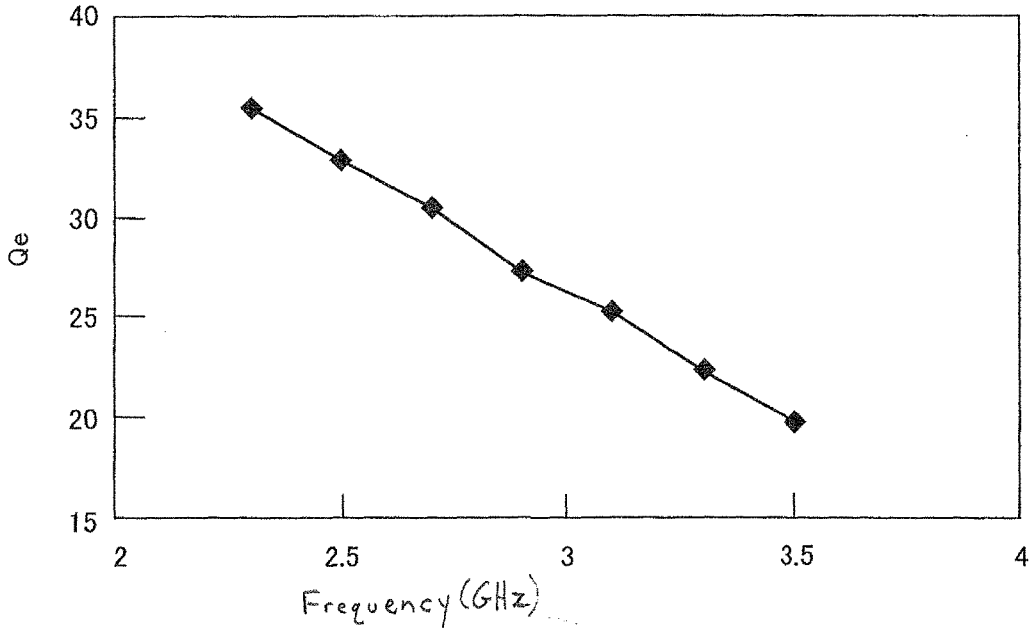
FIG. 6 is a graph illustrating a relation between a length of a probe and an external Q-value in the second embodiment of the dielectric waveguide resonator according to the present invention.

FIG. 6 is a graph illustrating a relation between a length of a probe and an external Q-value around the third harmonic of the dielectric waveguide resonator of the second embodiment. In FIG. 6, the horizontal axis represents a frequency in GHz, and the vertical axis represents Qe, an external Q-value.

Figure 7:
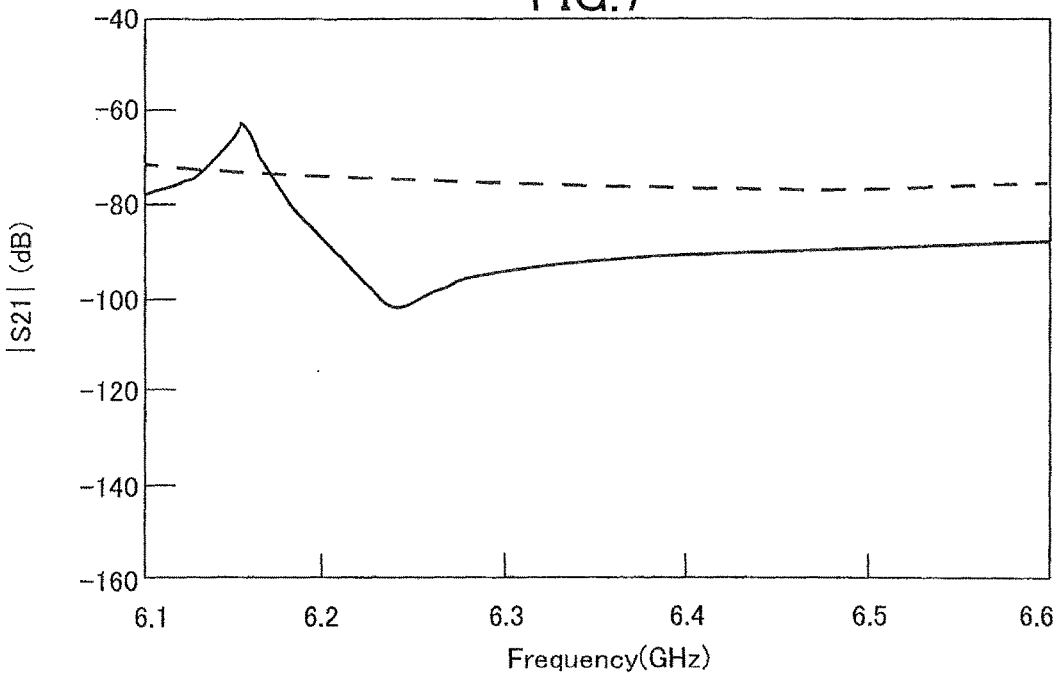
FIG. 7 is a graph illustrating insertion losses around a third harmonic in the second embodiment of the dielectric waveguide resonator according to the present invention.

FIG. 7 is a graph for comparing insertion losses of the dielectric waveguide resonator of the second embodiment around a third harmonic according to the presence or absence of the stub. In FIG. 7, the horizontal axis represents a frequency in GHz, and the vertical axis represents $|S_{21}|$ an insertion loss $|S_{21}|$ in dB, wherein the solid line represents a case where there is a stub, and the dashed line represents a case where there is not a stub. In FIG. 7, the length of the stub is: $L_s$=2.8 mm.

The results of FIGS. 5 to 7 indicate that: the dielectric waveguide resonator of the second embodiment operates as a dielectric waveguide resonator even if the dielectric block is divided into dielectric block pieces; the longer the length of the probe $L_f$ is, the smaller the external Q-value Qe becomes; and the third harmonic can be suppressed by the stub.

In the above described embodiments, the probe is formed in either one dielectric block piece. Alternatively, it may be possible to form the probe in both dielectric block pieces in the same manner. Further, it may also be possible to form the probe in both dielectric block pieces in different shapes, so as to have a desired shape when the dielectric block pieces come in contact with each other. For example, in the second embodiment, it is possible to form the probe in the contact surface of one dielectric block piece and to form the stub on the contact surface of the other dielectric block piece, so as to have a probe with stub when the two dielectric block pieces come in contact with each other. In the case where the same probe shape is formed on each contact surface of the both dielectric block pieces, it becomes possible to diminish the effect caused by a displacement when the dielectric block pieces come in contact with each other, by forming one shape slightly smaller than the other shape.

Fourth Embodiment

Figure 8:
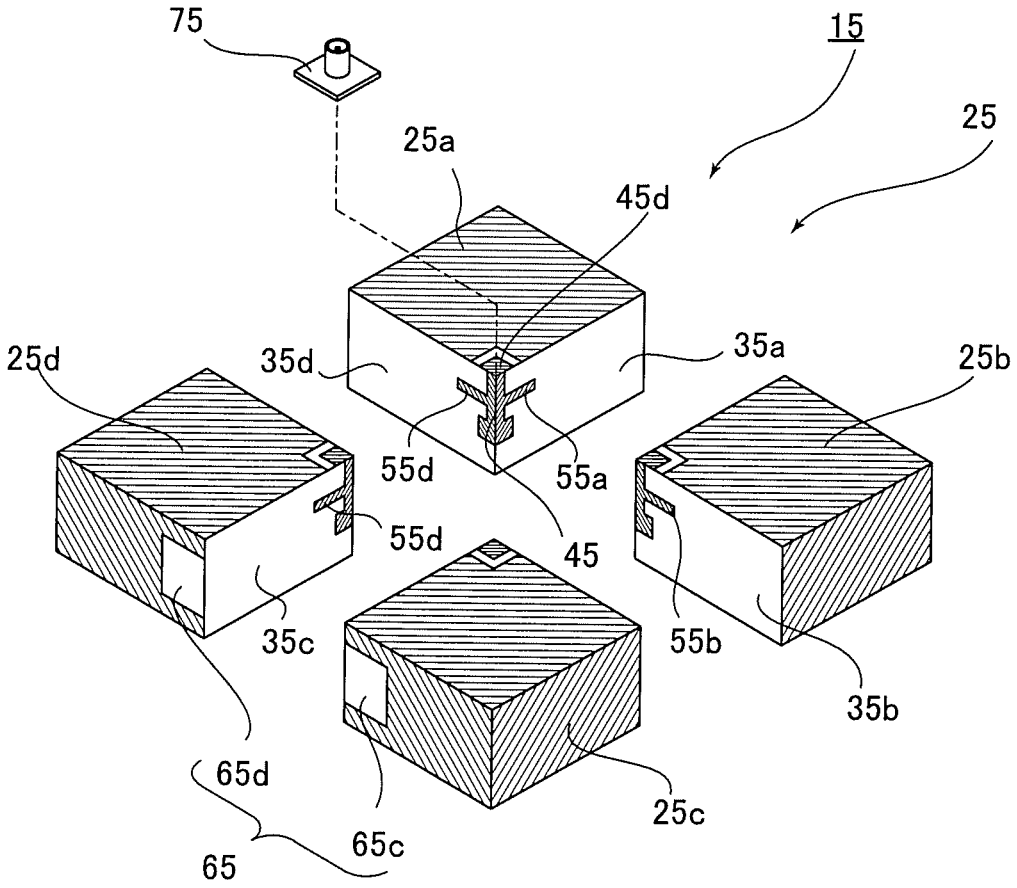
FIG. 8 is an exploded perspective view illustrating a fourth embodiment of the dielectric waveguide resonator according to the present invention.

Since the dielectric block may be divided into dielectric block pieces along a surface parallel to the surface current, the dielectric block is not limited to being divided into two pieces, but may be divided in more complicated manner. FIG. 8 is an exploded perspective view for explaining a fourth embodiment of the dielectric waveguide resonator according to the present invention. In FIG. 8, the shaded area represents an electrically conductive film.

The dielectric waveguide resonator 15, as illustrated in FIG. 8, comprises cubic-shaped dielectric block pieces 25*a*, 25*b*, 25*c* and 25*d*, and a coaxial connector 75, wherein dielectric block pieces 25*a*, 25*b*, 25*c* and 25*d* are obtained by dividing a dielectric block 25 into four pieces in a cross shape as viewed planarly.

When the contact surface region between the dielectric block pieces 25*a* and 25*b* is designated as a contact surface region 35*a*, the contact surface region between the dielectric block pieces 25*b* and 25*c* is designated as a contact surface region 35*b*, the contact surface region between the dielectric block pieces 25*c* and 25*d* is designated as a contact surface region 35*c*, and the contact surface region between the dielectric block pieces 25*d* and 25*a* is designated as a contact surface region 35*d*, then a probe 45 connected to a feeding point 45*d* provided on an outer periphery of the dielectric block 25 is provided on the corner at which the four contact surface regions 35*a*, 35*b*, 35*c* and 35*d* come in contact with each other, and each of the contact surface regions 35*a*, 35*b*, 35*c* and 35*d* includes respective one of stubs 55*a*, 55*b*, and 55*d* provided therein.

The dielectric waveguide resonator 15 has one side surface provided with a coupling window 65 composed of a rectangular exposed dielectric portion 65*c* provided in the dielectric block piece 25*c* so as to come adjacent to the contact surface region 35*c*, and of a rectangular exposed dielectric portion 65*d* provided in the dielectric block piece 25*d* so as to come adjacent to the contact surface region 35*c*.

In this way, when the dielectric block is divided into a plurality of dielectric pieces and there are a plurality of contact surface regions, the stub can be provided in any contact surface regions as necessary. The dielectric waveguide resonator is not limited to the rectangular parallelepiped shape. Thus, if the dielectric waveguide resonator has, for example, an octagon shape as viewed planarly, and the direction of the surface current is equal to the direction from the center to each vertex of the octagon shape, then it is also possible to divide the dielectric block into eight triangular prism-shaped dielectric block pieces.

Fifth Embodiment

Figure 9:
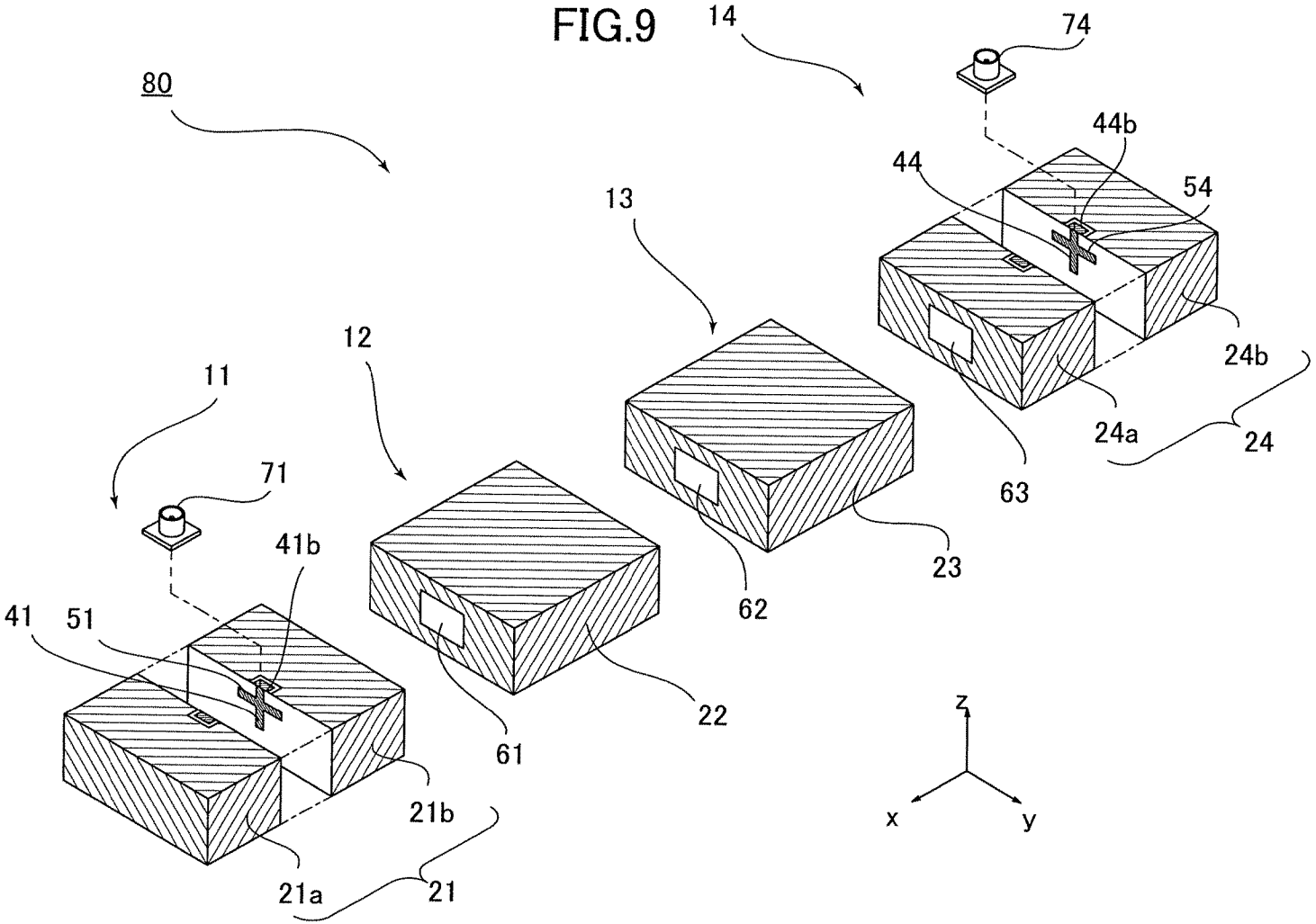
FIG. 9 illustrates an embodiment of a dielectric waveguide filter comprising the dielectric waveguide resonator according to the present invention.

FIG. 9 is an embodiment of a dielectric waveguide filter comprising the dielectric waveguide resonator of the second embodiment for input/output thereof.

As illustrated in FIG. 9, a dielectric waveguide filter 80 comprises dielectric resonators 11, 12, 14 and 14 serially connected via a coupling window 61 provided between the dielectric resonators 11 and 12, a coupling window 62 provided between the dielectric resonators 12 and 13, and a coupling window 63 provided between the dielectric resonators 13 and 14. The dielectric waveguide resonator 11 comprises a dielectric block 21 composed of dielectric block pieces 21*a* and 21*b* being in contact with each other, and a coaxial connector 71. The dielectric waveguide resonator 14 comprises a dielectric block 24 composed of dielectric block pieces 24*a* and 24*b* being in contact with each other, and a coaxial connector 74. The dielectric waveguides 12 and 13 comprise dielectric blocks 22 and 23, respectively. The dielectric waveguide resonators 11 and 14 are essentially the same as the dielectric waveguide resonator illustrated in the second embodiment, so that any explanation thereof will be omitted.

FIG. 9 further depicts a probe 41, feed point 41*b*, probe 44, feed point 44*b*, stub 51, and stub 54, all shown in a cartesian coordinate system, X, Y, Z.

The dielectric waveguide resonator 11 comprises a dielectric block 21 composed of dielectric block pieces 21*a* and 21*b* being in contact with each other, and a coaxial connector 71. The dielectric waveguide resonator 14 comprises a dielectric block 24 composed of dielectric block pieces 24*a* and 24*b* being in contact with each other, and a coaxial connector 74. The dielectric waveguides 12 and 13 comprise dielectric blocks 22 and 23, respectively. The dielectric waveguide resonators 11 and 14 are essentially the same as the dielectric waveguide resonator illustrated in the second embodiment, so that any explanation thereof will be omitted.

FIG. 9 further depicts a probe 41, feed point 41*b*, probe 44, feed point 44*b*, stub 51, and stub 54, all shown in a cartesian coordinate system X, Y, 2.

Figure 10:
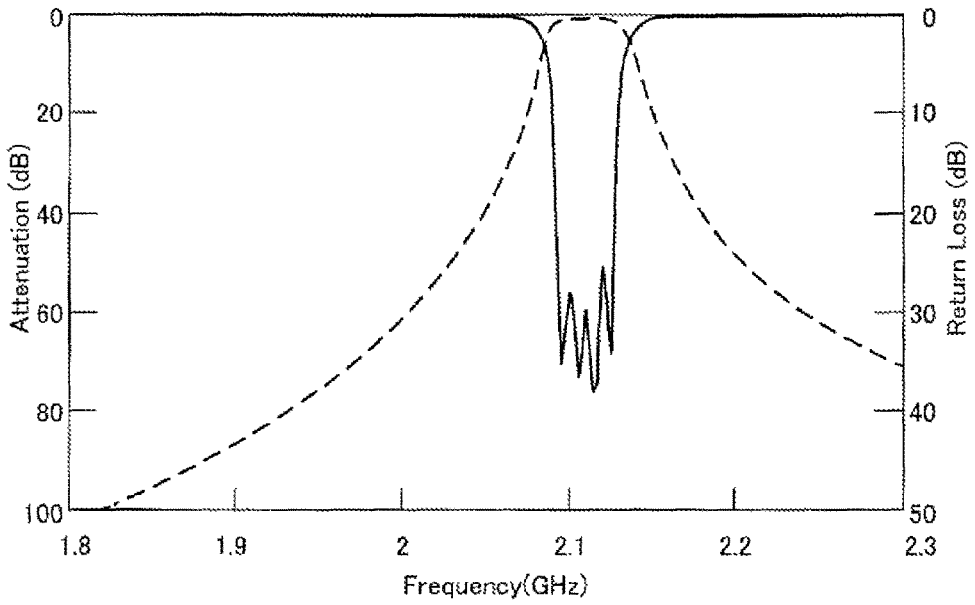
FIG. 10 is a graph illustrating an insertion loss and a return loss of the dielectric waveguide filter in FIG. 9.

FIG. 10 is a graph illustrating an insertion loss or attenuation in dB and a return loss in dB of the dielectric waveguide filter 80. In the figure, the horizontal axis represents a frequency in GHz, and the vertical axis represents dB, wherein the solid line represents the insertion loss, and the dashed line represents the return loss with and without a stub, similar to FIG. 7.

The dielectric waveguide filter 80 is designed to have the following values:

dimension of the dielectric waveguide resonator 11: L=20.35 mm, W=22 mm, H=4 mm;

dimension of the dielectric waveguide resonator 12: L=20.57 mm, W=22 mm, H=4 mm;

dimension of the dielectric waveguide resonator 13: L=20.57 mm, W=22 mm, H=4 mm;

dimension of the dielectric waveguide resonator 14: L=20.35 mm, W=22 mm, H=4 mm;

dimension of the coupling window 51: $W_w$=4.51 mm, $H_w$=3.00 mm;

dimension of the coupling window 52: $W_w$=3.96 mm, $H_w$=3.00 mm;

dimension of the coupling window 53: $W_w$=4.51 mm, $H_w$=3.00 mm;

dimension of the probes 41 and 44: $L_f$=2.8 mm, $W_f$=0.8 mm;

dimension of the stubs 51 and 54: $L_s$=2.8 mm; and relative permittivity of the dielectric block pieces 21*a*, 21*b*, 24*a* and 24*b*, and the dielectric blocks 22 and 23: $\varepsilon_r$=21.

The graph shows that the dielectric waveguide filter 80 is operating as a bandpass filter having a center frequency of 2.13 GHz and a bandwidth of approximately 40 MHz.

Figure 11:
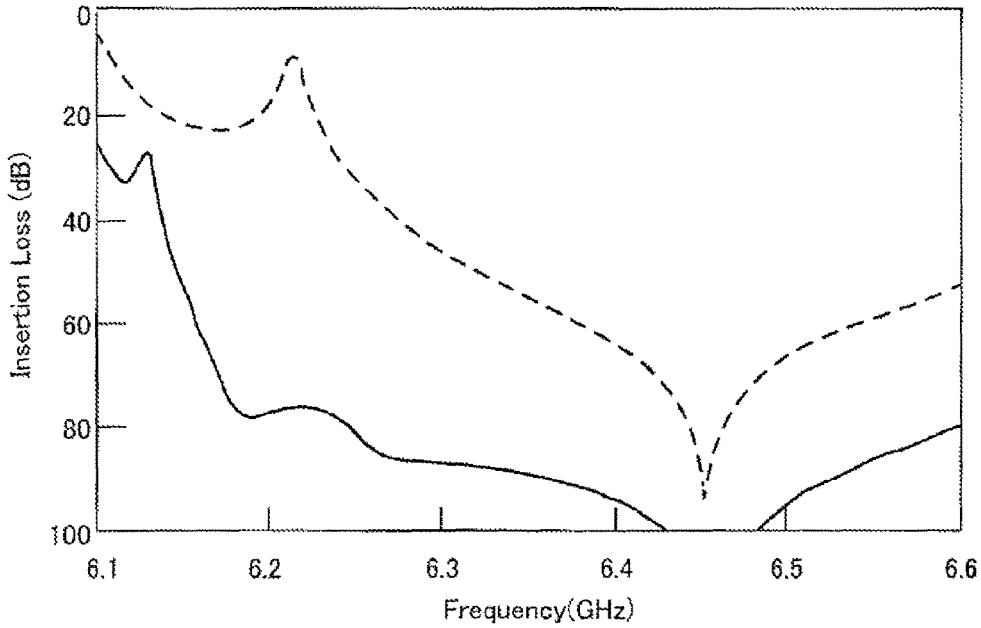
FIG. 11 is a graph illustrating a difference in the insertion loss of the dielectric waveguide filter in FIG. 9 according to the presence or absence of a stub.
Figure 12:
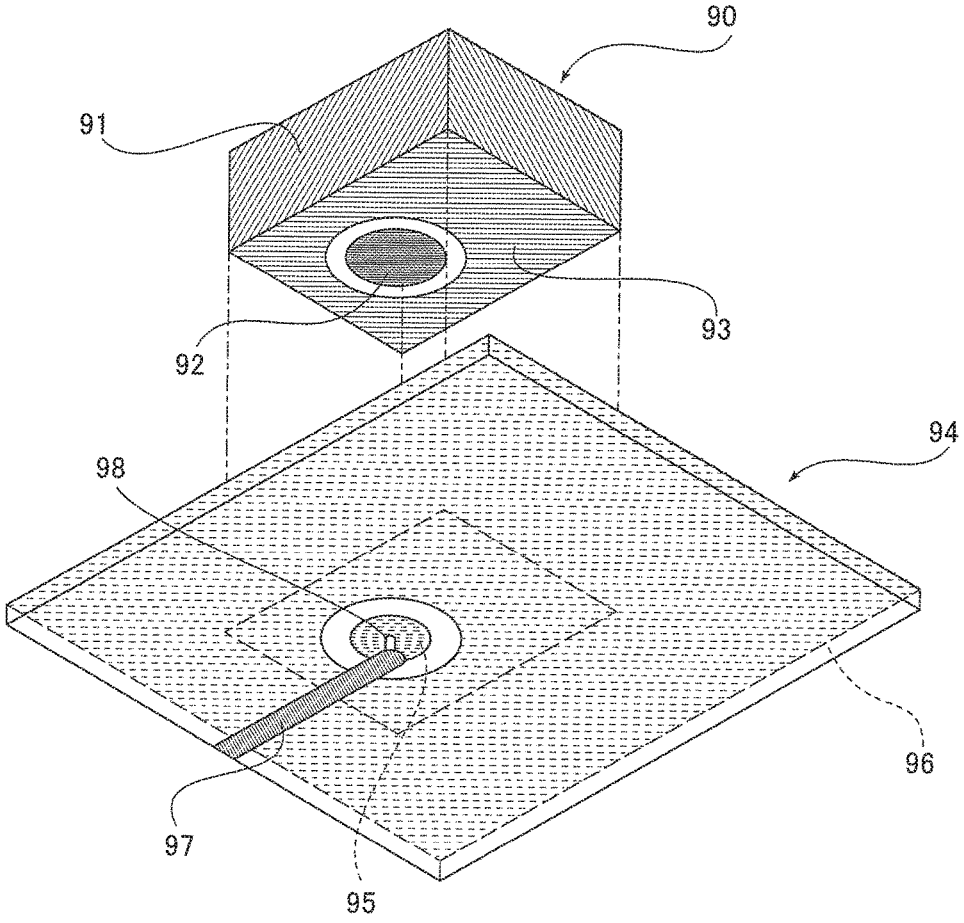
FIG.12 PRIOR ART
FIG. 12 is an exploded perspective view illustrating an example of the conventional dielectric waveguide resonator having a structure for conversion between a dielectric waveguide and a microstrip.

FIG. 11 is a graph illustrating an insertion loss of the dielectric waveguide filter 80 around a third harmonic, in which the horizontal axis represents a frequency in GHz, and the vertical axis represents insertion loss in dB, wherein the dashed line represents, for comparison, an insertion loss in the case where there is not any stub.

FIG. 11 shows that the insertion loss around a third harmonic can be suppressed by the effect of the stub.

As stated above, according to the various embodiments of the dielectric waveguide resonator of the present invention, it becomes possible to provide a structure for conversion between a dielectric waveguide and a coaxial line with a simple structure requiring no increase in the number of components and the cost.

EXPLANATION OF REFERENCE LABELS

10, 11 to 14, 90: dielectric waveguide resonator
10*a*, 10*b*, 93: electrically conductive film
20, 21 to 24, 25, 91: dielectric block
20*a*, 20*b*, 21*a*, 21*b*, 24*a*, 24*b*, 25*a*, 25*b*, 25*c*, 25*d*: dielectric block piece
30: contact surface
35*a*, 35*b*, 35*c*, 35*d*: contact surface region
40, 41, 44, 45: probe
40*a*: distal end
40*b*, 41*b*, 44*b*, 45*b*: feeding point
50, 51, 54, 51: stub
60 to 64, 65: coupling window
65*c*, 65*d*: exposed dielectric portion
70, 71, 74, 75: coaxial connector
80: dielectric waveguide filter
92: island-shaped electrode
94: printed circuit board
95: input/output electrode
96: surface ground pattern
97: microstrip line
98: through-hole

What is claimed is:

1. A dielectric waveguide resonator comprising:

a rectangular parallelepiped-shaped dielectric block having an upper surface, a lower surface, and an outer periphery surface, wherein the outer periphery surface is coated with an electrically conductive film, the dielectric waveguide resonator is configured to resonate in a TE mode, the dielectric block comprises a pair of rectangular parallelepiped-shaped dielectric block pieces opposing each other at respective contact surfaces, each parallel to a surface current, wherein the pair of dielectric block pieces have an electrically conductive film piece formed on each of the contact surfaces so as to make a probe in a gap between the contact surfaces when the contact surfaces oppose each other;

wherein the electrically conductive film is also formed on the upper surface and the lower surface; and wherein the upper surface has a feeding pattern which is insulated from the electrically conductive film formed thereon and is connected to the probe.

2. The dielectric waveguide resonator as defined in claim 1, wherein a stub composed of the electrically conductive pieces is formed on each of the contact surfaces of the pair of dielectric block pieces.

3. The dielectric waveguide resonator as defined in claim 1, wherein a stub composed of the electrically conductive film piece is formed on at least one of the contact surfaces.

4. A dielectric waveguide resonator comprising:

a dielectric block, having an upper surface, a lower surface, and an outer periphery surface, wherein the outer periphery surface is coated with an electrically conductive film, the dielectric waveguide resonator is configured to resonate in a TE mode, wherein the dielectric block comprises: a plurality of substantially same-shaped dielectric block pieces opposing each other, through respective contact surfaces thereof each parallel to a surface current, wherein the pair of dielectric block pieces have an electrically conductive film for a probe formed on each of the contact surfaces;

wherein the electrically conductive film is also formed on the upper surface and the lower surface; and wherein the upper surface has a feeding pattern which is insulated from the electrically conductive film formed thereon and is connected to an electrically conductive pattern for a probe formed thereon.

5. The dielectric waveguide resonator as defined in claim 4, wherein a stub composed of the electrically conductive pattern is formed on at least one of the contact surfaces.

6. The dielectric waveguide resonator as defined in claim 4, wherein a stub composed of the electrically conductive pattern is formed on each of the contact surfaces of the pair of dielectric block pieces.

7. A dielectric waveguide filter comprising a plurality of dielectric waveguide resonators serially connected via a respective coupling window provided between adjacent ones of the plurality of dielectric waveguide resonators, wherein the dielectric waveguide filter has an input/output portion comprising the plurality of dielectric waveguide resonators as defined in any of claims 1, 3, 2, 5, or 6.

* * * * *